US006749090B2

(12) United States Patent
Bailey

(10) Patent No.: US 6,749,090 B2
(45) Date of Patent: Jun. 15, 2004

(54) DUAL BLADDER SPORTS HYDRATION SYSTEM

(75) Inventor: Randall B. Bailey, Sun Prairie, WI (US)

(73) Assignee: Trek Bicycle Corporation, Waterloo, WI (US)

( * ) Notice: Subject to any disclaimer, the term of this patent is extended or adjusted under 35 U.S.C. 154(b) by 0 days.

(21) Appl. No.: 10/237,849

(22) Filed: Sep. 9, 2002

(65) Prior Publication Data

US 2003/0075573 A1 Apr. 24, 2003

Related U.S. Application Data

(60) Provisional application No. 60/340,931, filed on Oct. 22, 2001.

(51) Int. Cl.[7] ..... B67D 05/64

(52) U.S. Cl. ..... 222/175; 222/107; 222/145.5

(58) Field of Search ..... 222/175, 107, 222/145.5; 604/6.1; 251/9, 10, 207

(56) References Cited

U.S. PATENT DOCUMENTS

| | | | | | |
|---|---|---|---|---|---|
| 486,698 | A | * | 11/1892 | Ketchum | 423/38 |
| 1,964,362 | A | | 6/1934 | Nassif | |
| 3,197,071 | A | | 7/1965 | Kuster | |
| 3,272,387 | A | | 9/1966 | Katz et al. | |
| 3,411,534 | A | * | 11/1968 | Rose | 137/595 |
| 3,876,112 | A | | 4/1975 | Kramer | |
| 4,061,142 | A | * | 12/1977 | Tuttle | 604/34 |
| 4,425,113 | A | * | 1/1984 | Bilstad | 604/6.04 |
| 4,526,298 | A | | 7/1985 | Boxer et al. | |
| 4,739,905 | A | | 4/1988 | Nelson | |
| 4,753,371 | A | * | 6/1988 | Michielin et al. | 222/144.5 |
| 4,856,995 | A | | 8/1989 | Wagner | |
| 5,188,266 | A | | 2/1993 | Loulias | |
| 5,332,157 | A | | 7/1994 | Proctor | |
| 5,405,030 | A | | 4/1995 | Frazier | |
| 5,433,350 | A | | 7/1995 | Graubart | |
| 5,753,289 | A | | 5/1998 | Ness | |
| 5,794,819 | A | | 8/1998 | Smith | |
| 5,816,457 | A | | 10/1998 | Croft | |
| 5,865,797 | A | * | 2/1999 | Zeeman | 604/80 |
| 5,911,406 | A | * | 6/1999 | Winefordner et al. | 251/339 |
| 5,921,440 | A | | 7/1999 | Maines | |
| 5,947,335 | A | | 9/1999 | Milio et al. | |
| 5,967,308 | A | * | 10/1999 | Bowen | 206/219 |
| 5,967,315 | A | | 10/1999 | Langtry, II | |
| 6,010,034 | A | | 1/2000 | Walthers | |
| 6,039,305 | A | | 3/2000 | Hoskins et al. | |
| 6,062,435 | A | | 5/2000 | Hess, III | |
| 6,112,952 | A | | 9/2000 | Hess, III et al. | |
| 6,164,822 | A | | 12/2000 | Beer | |
| 6,179,146 | B1 | | 1/2001 | Betras | |
| 6,283,344 | B1 | | 9/2001 | Bradley | |
| 6,589,197 | B1 | * | 7/2003 | Doi et al. | 604/6.1 |

FOREIGN PATENT DOCUMENTS

| | | | | |
|---|---|---|---|---|
| EP | 1 106 191 A1 | * | 6/2001 | A61M/1/28 |
| WO | WO 00/10626 | * | 3/2000 | A61M/1/28 |

* cited by examiner

*Primary Examiner*—Gene Mancene
*Assistant Examiner*—Melvin Cartagena
(74) *Attorney, Agent, or Firm*—David C. Brezina; Barnes & Thornburg

(57) ABSTRACT

An improved sports hydration system uses a plurality of bladders and tube branches communicating through tube branch controlling valve to a single feed tube.

19 Claims, 3 Drawing Sheets

40
26
24
205L
205R
158
200
202
204
206
208
210
212
214
218
220
222
224
226
228
230
232
236
238
240
242
244
246
252
254
256
258
270
272
274
276
278

DUAL BLADDER SPORTS HYDRATION SYSTEM

CLAIM OF PRIORITY

Priority is claimed based on U.S. Provisional Application Serial No. 60/340,931 filed Oct. 22, 2001 entitled "Dual Bladder Sports Hydration System" and invented by Randall B. Bailey.

BACKGROUND OF THE INVENTION

1. Summary of the Invention

A sports hydration system uses separate bladders or bladder portions containing different fluids, such as an electrolyte sports drink and water, or separate quantities of the same fluid. Each separate bladder or bladder portion feed to separate tube branches. Each branch communicates through a lever or arm operated valve to a single feed tube. In this manner the user can switch between the preferred beverage, feed both beverages, close both, or otherwise use the selection function for endurance and training advantage.

2. Description of Related Art

Sports hydration systems have developed primarily in the area of improved suspension, improved tube routing and improved terminals, outlets or 'bite' valves. While these are useful improvements they fail to address a primary limitation, namely that each arrangement is operably limited to the supply of a single fluid at a time.

A "Y" connector is used in U.S. Pat. No. 5,816,457 to join separate outlet tubes to a single bladder, the disclosure of this patent being incorporated by reference as if fully set forth herein. A dual function outlet is used in U.S. Pat. No. 4,526,298, changing outlet flow between a stream and a mist, from a single bladder, the disclosure of this patent being incorporated by reference as if fully set forth herein. Bite valves or outlet valves are also taught in U.S. Pat. Nos. 6,039,305 and 6,062,435, the disclosure of these patents being incorporated by reference as if fully set forth herein. Routing of the feed tube is taught in U.S. Pat. No. 6,283,344, the disclosure of this patent being incorporated by reference as if fully set forth herein.

The athlete or sportsperson, however, frequently desires alternative fluids during the course of an event or activity. For example, electrolyte sports drinks, such as Gatorade, can provide important performance enhancing elements, yet at other times, pure water is preferred, whether for taste or other functional reasons, or simple preference. Separate bladders can also be used to monitor or ration fluids, such as providing one bladder for a bicycle ride or run in one direction, with the exhaustion of that bladder signifying the need to return to a starting point and the second bladder providing hydration for the return.

DETAILED DESCRIPTION OF THE PREFERRED EMBODIMENT

Figure 1:
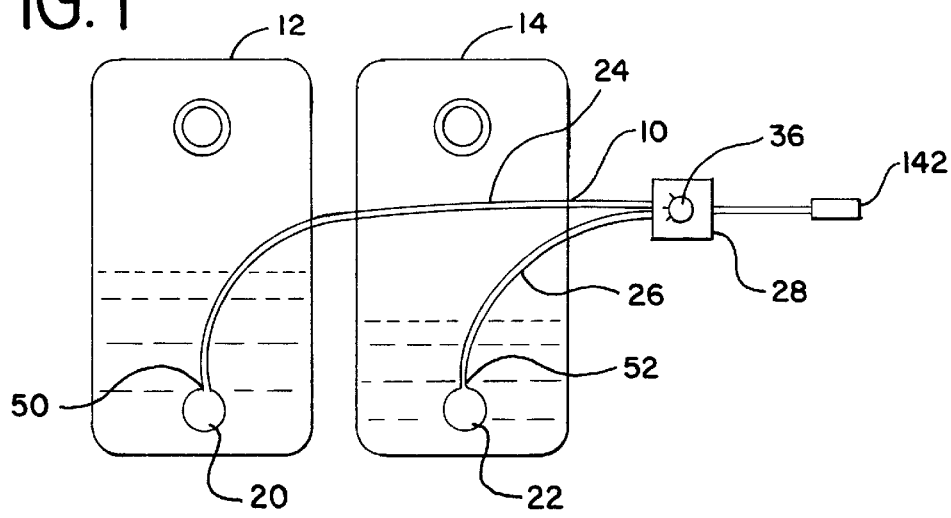
FIG. 1 is an elevational view of the components of the multiple bladder hydration system.
Figure 2:
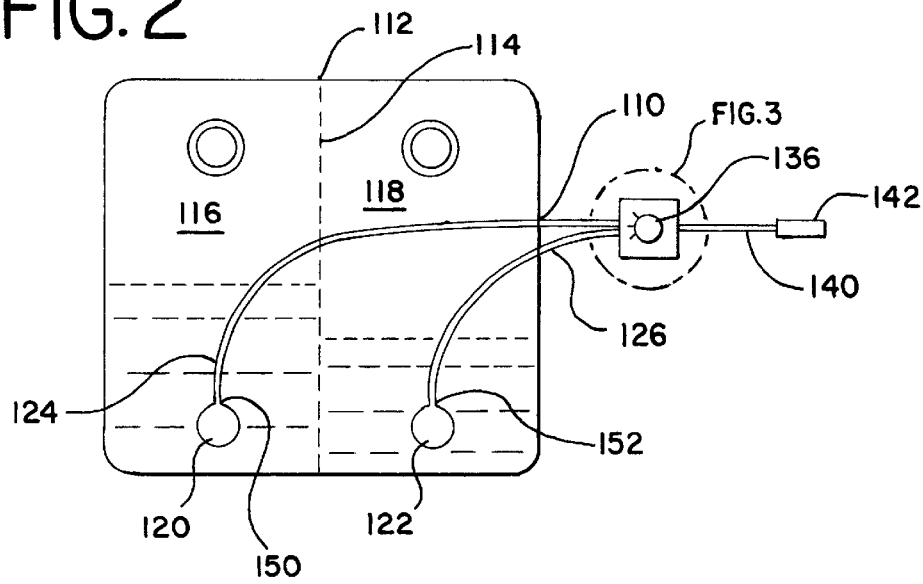
FIG. 2 is an elevational view of the components of the single bladder, multiple portion hydration system.
Figure 3:
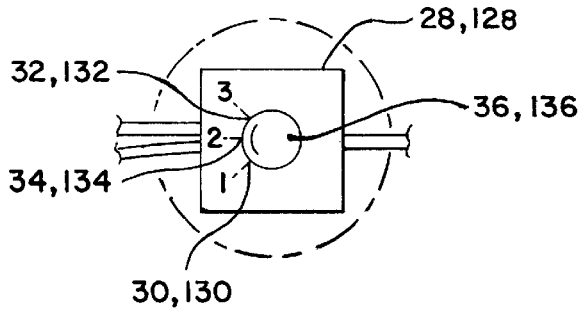
FIG. 3 is an elevational view of the valve.

A hydration system 10 has a plurality of bladders 12, 14. Each bladder 12, 14 flows through an outlet 20, 22 to a tube branch 24, 26. Tube branches 24, 26 interconnect at a valve 28, controlled between positions off 30, left 32 and right 34. Selecting positions off 30, left 32 and right 34 is accomplished by moving lever 36. In the preferred embodiment (FIG. 6–8) positions off 30, left 32 and right 34 are selected by the selective engagement or disengagement of cam arms 204, 206 as more fully described below. The terms "left" and "right" are relative, as the unit could be inverted, for example, while in use Valve 28 then permits fluid passage to feed tube 40 and thence to mouthpiece or bite valve 42.

In the alternative hydration system 110 has a single bladder envelope 112. bladder envelope 112 is subdivided by seam or baffle 114 into left and right bladder sections 116, 118. bladder sections 116, 118 flow through an outlet 120, 122 to a tube branch 124, 126. Tube branches 124, 126 interconnect at a valve 128, controlled between positions off 130, left 132 and right 134. Selecting positions off 130, left 132 and right 134 is accomplished by moving lever 136. Valve 128 then permits fluid passage to feed tube 140 and thence to mouthpiece or bite valve 142.

Bladders 12, 14 or 112 may be formed by a variety of methods that result in a durable, sanitary, economical, flexible reservoir that is chemically compatible with water or typical sports drinks. Vinyl sheet that is heat or ultrasonically welded is suitable. Similar materials can be used for outlets 20, 22, 120, 122, although a hybrid of a formed outlet in the bladder and a tubing connection 50, 52 or 150, 152 may be used, wherein the tubing connection may be either a durable, complex connection, such as a pivoting connection, a simple hose receiving barb type connection, or a permanent hose connection.

Tube branches 24, 26, 124, 126 can join either directly to valve 28, 128 or can be joined at a "Y" connector 158 to tube 40, 140. In the former arrangement, flow is directly through valve 28, 128, wherein valve 28, 128 functions in the manner of a directional flow control valve 160, having appropriate inlet and outlet fittings for the respective tubes. In the alternative, a ball valve could also be used, set up in the manner of a flow control valve to direct flow between off 30, 130, left 32, 132 and right 34, 134 positions.

As another alternative, a pinch valve type 162 can be used where valve 28, 128 indirectly controls flow by selectively pinching one or both of tube branches 24, 26, 124, 126. By pinching one branch and not the other, flow is controlled, but only the tube contacts the water or sports drink, facilitating easy cleaning. By pinching both branches, flow is completely cut off.

Figure 4:
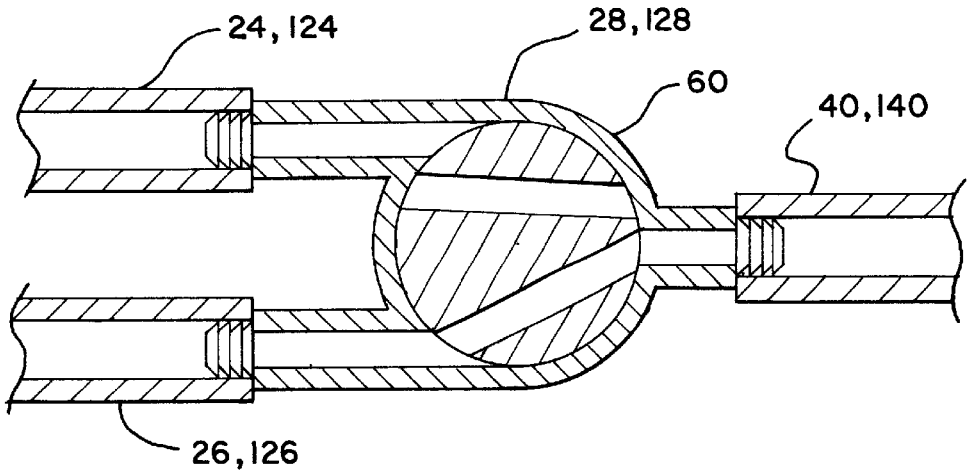
FIG. 4 is a sectional view of a directional flow control valve.
Figure 5:
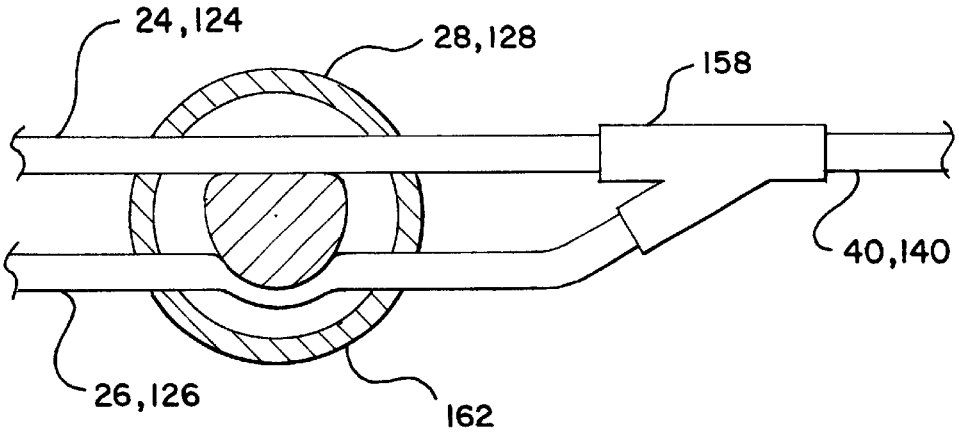
FIG. 5 is a sectional view of a pinch valve controlling flow.
Figures 6, 7, 8:
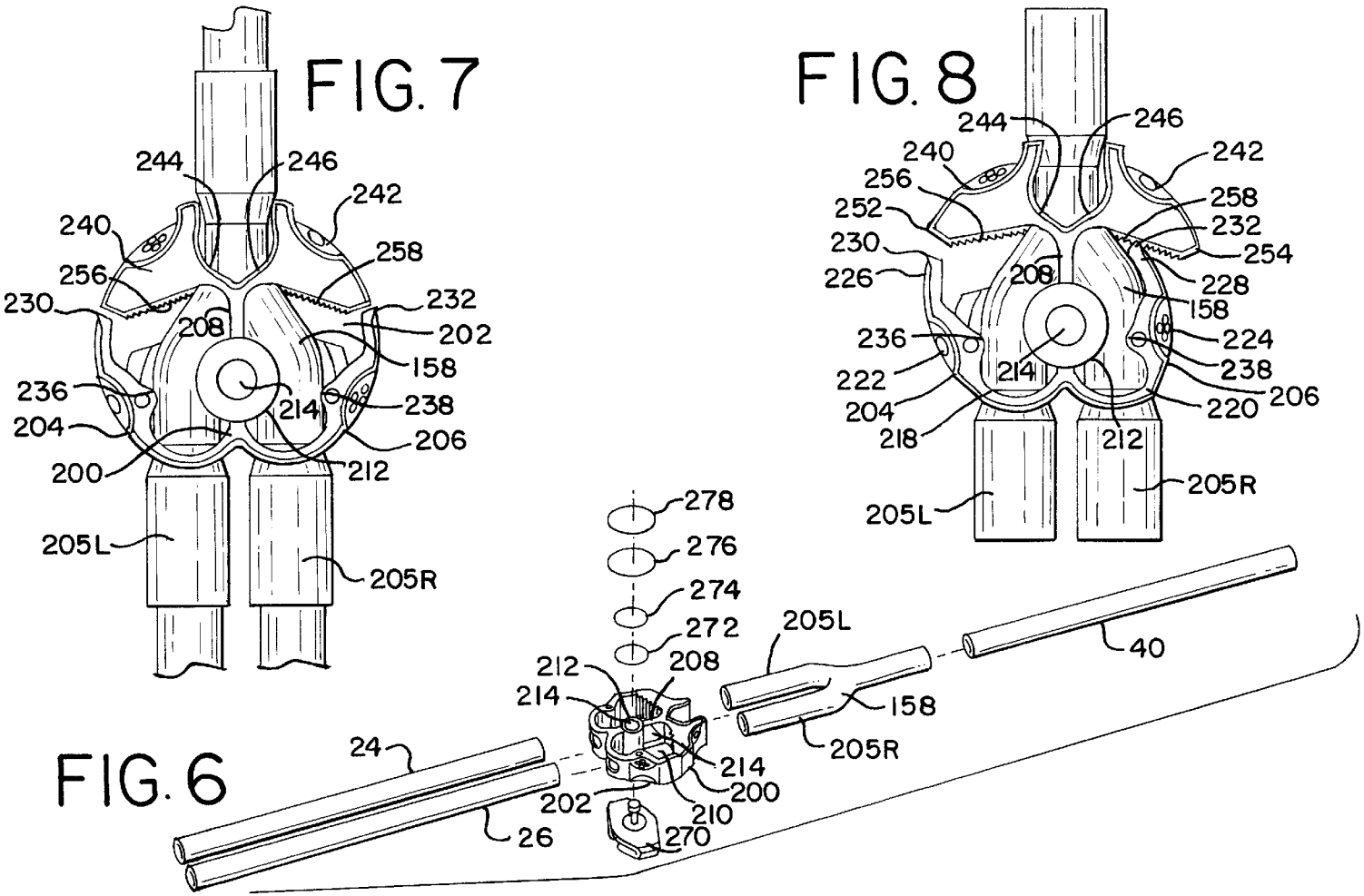
FIG. 6 is a perspective view of a preferred embodiment of a pinch valve.
FIG. 7 is a plan view of a preferred pinch valve in a both sides open configuration.
FIG. 8 is a plan view of a preferred pinch valve with a right side closed and left side open configuration.

While alternative valve arrangements such as a pinch valve with a rotating cam or a dual flow valve may be used, as shown in FIG. 4 and FIG. 5, a pawl and rack locking pinch valve is preferred. This embodiment is shown in FIGS. 6–8. Valve 200 has a body 202 comprising left and right pinch cam arms 204, 206 extending from central rib 208. Rib 208 is spaced from lower rib 210. Rib 208 has an enlarged cylindrical portion 212 that defines a clip post receiving aperture 214. "Y" connector 158 fits in a slot 216 in between ribs 208, 210 and the legs 205 L and 205 R of conduit 158 pass on either side of cylindrical portion 212. Each arm 202, 204 has a resilient web 218, 220 attaching it to rib 208. Each arm 202, 204 has a finger grip 222, 224 and then an end 226, 228 opposite the respective webs 218, 220. Ends 226, 228 terminate in pawls 230, 232. Generally opposite finger grips 222, 224 facing "Y" connector 158 are cam surfaces 236, 238.

At the top portion of body 202 are left and right rack members 240, 242. Rack members 240, 242 are fixed to rib 204 with resilient webs 244, 246 in a "T" shaped configuration. Each member 240, 242 has a finger grip 248, 250 and then an end 252, 254 opposite one another, on either side of the respective webs 244, 246. Ends 252, 254 terminate in racks 256, 258 which are engageable with pawls 230, 232. FIG. 8 shows the valve 202 with the respective arms 204, 206 and rack members 240, 242 in disengaged condition. Fig. Shows right arm 206 engaged with rack 158 and member 240 displaced to disengage rack 256 from pawl 230.

It will be observed that valve 200 in FIG. 8 is in the position 32 for the left tube to be used. This is because rack 256 is disengaged, thereby enabling free flow through legs 205 L because cam 236 is not compressing leg 205 L, while cam 238 is compressing, and therefore closing, leg 205 R to fluid flow. Engagement of rack 258 and pawl 232 is holding cam 238 tightly against leg 205R, compressing leg 205R against cylindrical portion 212 to stop fluid flow therethrough. Closing cam member 204 while leaving cam member 206 engaged would change valve 200 to the off position 30, and in turn, disengaging rack 258 and pawl 232 while leaving cam member 204 closed would place valve 200 in the right position 34. FIG. 7 provides a both "on" position As shown more fully in FIG. 6, valve 200 is completed by the compression fitting of clip 270 through aperture 214. Aperture 214 is then closed by affixation of cap 272 and decal 274. Alternate, larger cap 276 and decal 278 could also be used.

While the present invention has been disclosed and described with reference to these embodiments, it will be apparent that variations and modifications may be made therein. It is also noted that the present invention is independent of the specific hydration system, and is not limited to the specific hydration system. It is, thus, intended in the following claims to cover each variation and modification that falls within the true spirit and scope of the present invention.

I claim:

1. A hydration system leading to a feed tube comprising:

a plurality of bladders;

each of said bladders formed to enable flow through an outlet;

each of said outlets communicating to a tube branch;

said tube branches interconnecting at a six mode selector valve;

said valve being controlled between positions of left off, right off, left on, right on, both on and both off;

a hands free operable two position valve positioned downstream from the valve, said two position valve operable by a user, to permit fluid flow.

2. The hydration system of claim 1 further comprising:

said positions of left off, right off, left on, right on, both on and both off are selected by the selective engagement or disengagement of cam arms controlling the engagement and disengagement of pawls and racks within said selector valve.

3. The hydration system of claim 1 further comprising:

said bladders being formed by partitioning single bladder envelope;

said bladder envelope is subdivided by baffle into left and right bladder sections;

said bladder sections each flow through an outlet to said tube branch.

4. The hydration system of claim 3 further comprising:

said single bladder envelope being formed of thermoplastic sheet which is heat or ultrasonically welded to permanently define the envelope and bladder sections.

5. The hydration system of claim 4 further comprising:

outlets are integrally formed in and a tubing connection bonded to bladder sections to communicate between said bladder sections and said feed tube.

6. The hydration system of claim 4 further comprising:

outlets from said bladder sections being formed of a durable connection namely one of a pivoting connection, a hose receiving barb type connection, or a permanent hose connection.

7. The hydration system of claim 1 further comprising:

said tube branches are joined at a "Y" intersection to the feed tube such that said valve indirectly controls flow by selectively pinching one or both of tube branches of the selector valve so that by pinching one branch and not the other, flow is controlled, and by pinching both branches of the selector valve, flow is completely cut off, and only the tube, and not the valve, directly contacts the fluid passing therethrough.

8. The hydration system of claim 1 and said selector valve comprises one of:

a pinch valve with a rotating cam;

a dual flow valve having a rotating disc with internal conduits, or a pawl and rack locking pinch valve.

9. The hydration system of claim 1 and:

said selector valve comprises a pawl and rack locking pinch valve;

said selector valve having a body with left and right pinch cam arms extending from a central rib, said rib having a slot;

a "Y" intersection being formed of a connector fitting in said slot formed and arranged so that first and second legs and of a conduit pass on either side of a cylindrical portion such that flow is controlled by selectively pinching one or both of tube branches, or neither of them.

10. The hydration system of claim 9 and:

each arm has a resilient web attaching said arm to said rib;

each arm further having a finger grip and an end opposite the respective webs;

said ends terminating in pawls.

11. The hydration system of claim 10 and:

cam surfaces located opposite said finger grips so that said cam surfaces face "Y" connector;

rack members located at the top portion of said body;

said rack members being fixed to said rib with resilient webs in a "T" shaped configuration.

12. The hydration system of claim 11 and:

said hydration system is a dual hydration system and said valve is symmetric about said rib such that said arms, racks, pawls and finger grips are independently operable opposed pairs.

13. A sports hydration system with a fluid receivable bladder and feed tube comprising:

a plurality of bladders;

tube branches leading from the bladders to a feed tube;

a tube branch controlling valve to a single feed tube;

said valve controlling passage of the fluid from said bladders to said feed tube between one bladder communicating to the feed tube, more than one bladder communicating to the feed tube, and all the bladders closed, said valve comprising one of:

a pinch valve with a rotating cam;

a dual flow valve having a rotating disc with internal conduits, or a locking pinch valve having a pawl and rack for each feed tube;

a bite valve positioned downstream from the valve, said bite valve bitable by a user, permitting fluid flow.

14. The hydration system of claim 13 and:

said valve comprises a pawl and rack locking pinch valve;

said valve having a body with left and right pinch cam arms extending from a central rib, said rib having a slot;

a "Y" intersection being formed of a connector fitting in said slot formed and arranged so that first and second legs and of a conduit pass on either side of a cylindrical portion such that flow is controlled by selectively pinching one or both of tube branches, or neither of them;

each arm has a resilient web attaching said arm to said rib;

each arm further having a finger grip and an end opposite the respective webs;

said ends terminating in pawls.

15. The hydration system of claim 14 and:

cam surfaces located opposite said finger grips so that said cam surfaces face "Y" connector;

rack members located at the top portion of said body;

said rack members being fixed to said rib with resilient webs in a "T" shaped configuration.

16. The hydration system of claim 15 and:

said hydration system is a dual hydration system and said valve is symmetric about said rib such that said arms, racks, pawls and finger grips are independently operable opposed pairs.

17. A flow control system for fluids comprising a fluid source and a fluid outflow conduit;

said source formed from a single pouch permanently divided to form two bladders, each bladder enabled to permit flow through a separate outlet;

a tube branch formed between said source and said conduit;

said tube branch connecting at a valve;

said valve being controlled between positions of off and on;

a valve having a pair of pawl and rack locking mechanisms controlling flow between said source and said conduit.

18. The flow control system of claim 17 and:

said valve having a body with a pinch cam arm extending from a central rib, said rib having a slot;

an intersection being formed of a connector fitting in said slot formed and arranged so that a conduit passes a bearing portion such that flow is controlled by selectively pinching or releasing said tube branch;

said arm has a resilient web attaching said arm to said rib;

said arm further having a finger grip and an end opposite said web;

said end terminating in a pawl;

a cam surface located opposite said finger grip so that said cam surface faces said connector;

a rack member located at the top portion of said body;

said rack member being fixed to said rib with a resilient web in a "T" shaped configuration.

19. The flow control system of claim 18 and:

said system is adapted for inclusion in a dual sports hydration system;

said outflow conduit is a feed tube;

said valve is symmetric about said rib such that there is a plurality of said branch, arm, rack, pawl and finger grip in independently operable opposed arrays such that there is a first and second branch, first and second arm, first and second rack, first and second pawl and first and second finger grip;

first and second branches are joined at a "Y" intersection to the feed tube such that said valve indirectly controls flow by selectively pinching one or both of said first and second branches so that by pinching one branch and not the other, flow is controlled, and by pinching both branches, flow is completely cut off, and only the tube, and not the valve, directly contacts the fluid passing therethrough.

* * * * *